United States Patent [19]

Gilmore

[11] Patent Number: 4,532,498

[45] Date of Patent: Jul. 30, 1985

[54] BURGLAR ALARM DEVICE

[76] Inventor: George T. Gilmore, 3113 Arrowood Dr., Raleigh, N.C. 27604

[21] Appl. No.: 540,317

[22] Filed: Oct. 11, 1983

[51] Int. Cl.[3] ..... G08B 13/08

[52] U.S. Cl. ..... 340/545; 340/541; 340/691

[58] Field of Search ..... 340/545, 691, 815.12, 340/815.15, 541, 524, 525, 763, 764, 783, 330, 331, 568, 686; 40/579, 580, 577, 463

[56] References Cited

U.S. PATENT DOCUMENTS

| | | | |
|---|---|---|---|
| 2,300,234 | 10/1942 | O'Gorman | 40/579 X |
| 4,045,794 | 8/1977 | Ohta | 340/691 X |
| 4,212,003 | 7/1980 | Mishoe et al. | 340/691 X |

*Primary Examiner*—Charles A. Ruehl
*Assistant Examiner*—Chi Keung Lau
*Attorney, Agent, or Firm*—Mills & Coats

[57] ABSTRACT

The present invention relates to a burglar alarm system for a building characterized by an electric sign adapted to illuminate a distress message in response to an unauthorized entry into the building. Forming a part of the alarm system is a series of switches with each switch being electrically connected in a circuit and mounted adjacent an entry way into the building and operative to actuate said sign and cause the presence of the distress message to appear thereacross in response to the unauthorized entry into the building through one of said entry ways.

7 Claims, 3 Drawing Figures

BURGLAR ALARM DEVICE

BACKGROUND OF INVENTION

In recent years the number of burglaries involving residential dwellings has been increasing steadily, and, of course, such criminal activity results in substantial losses to the occupants of such dwellings because much of the stolen property is never recovered. In addition, it is well appreciated that in some instances involving burglary, it is not uncommon for personal injury to occur to an individual in or around the building being burglarized. While police are interested in arresting and convicting burglars, it has been recognized that the public as a whole must become involved in protecting their own property if such criminal activity is going to be stopped and deterred.

In view of this, some communities and residential developments are utilizing security or watch personnel to patrol their streets. In addition, security industries have devised alarm systems that are adapted to be installed in the home to detect burglaries and to appraise surrounding neighbors or police of the presence of a burglary. Often such alarm systems are tied in with a nearby police station or some other type of central reporting station, while other types of burglary alarm systems are designed to give off an audible alarm when actuated. Although some conventional burglary alarm systems are effective, one finds that many commercial burglary alarm systems today are expensive and complicated and are not totally effective.

Thus, there exists today a real need for a simple and relatively inexpensive burglar alarm or signaling system that is effective and which will deter burglaries.

SUMMARY OF INVENTION

The present invention relates to a burglary alarm or signaling system that is relatively simple and inexpensive, and which is very effective in catching burglars in the criminal act and which will deter such criminal activity. Basically the burglary alarm or signaling system of the present invention entails a sign that is appropriately mounted outside a particular dwelling in a conspicuous location in order that the same can be seen, when actuated, from the street and by the nearby neighbors and which is effective to give off an illuminated distress or alarm message. In particular, the alarm signaling device is designed such that the distress message is camouflaged when the same is not in a active state, but which is adapted to be actuated by an unauthorized entry through any particular entry way, such as a door or window, of the particular structure or dwelling in which the alarm or signaling system is associated.

Therefore, it is appreciated that the alarm or signaling device of the present invention simply lights up a distress message in response to an unauthorized entry to a particular structure such that anyone patrolling the streets or anyone viewing the structure, such as a neighbor, is appraised of an unauthorized entry and consequently can take steps to contact the police and halt the burglary and to catch those individuals perpetrating the crime.

It is, therefore, an object of the present invention to provide a relatively simple and inexpensive signaling system that acts as an effective burglary alarm system.

A further object of the present invention is to provide a sign type signaling system for appraising passersby, and others in the vicinity, of an unauthorized entry to a house or other type of building having said sign type signaling system associated therewith.

Still a further object of the present invention is to provide a burglary alarm or signaling system that emits a visual silent distress message indicating a burglary about the premises of the structure as contrasted to an audible alarm.

Other objects and advantages of the present invention will become apparent from a study of the following description and the accompanying drawings which are merely illustrative of the present invention.

DESCRIPTION OF PREFERRED EMBODIMENT

Figure 1:
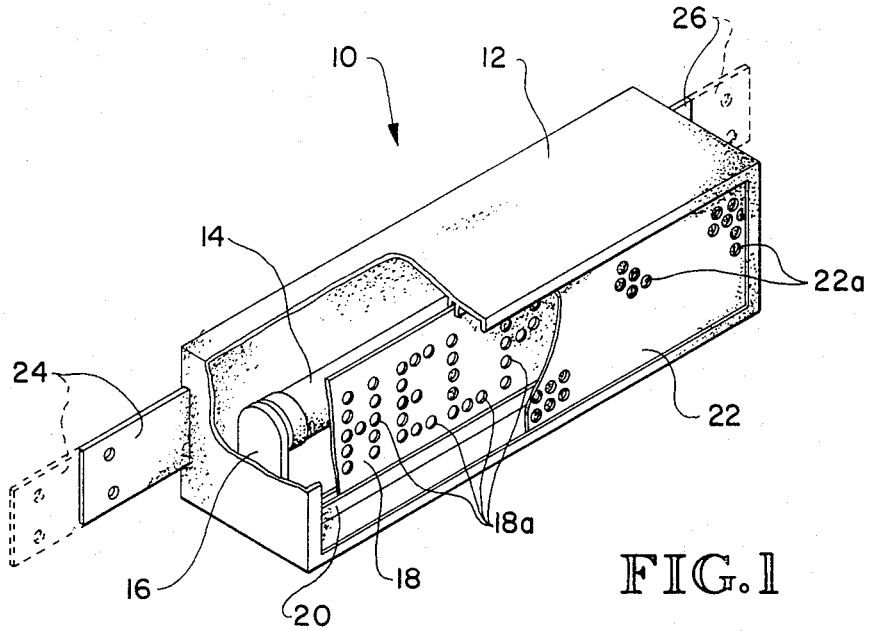
FIG. 1 is a perspective view of burglary signaling device of the present invention.

With further reference to the drawings, the alarm or signaling device of the present invention is shown in FIG. 1 and indicated generally by the numeral 10. Viewing the structure of the alarm or signaling device 10, it is seen that the same includes a generally elongated housing 12 having a generally rectangular cross sectional area.

Disposed within housing 12 is an elongated light 14 that is electrically mounted within a pair of spaced apart mounting arms 16 that extend upwardly from the bottom of housing 12.

Formed about the bottom of housing 12 and extending thereacross in front of light 14 is a groove holder 20 that is adapted to receive and support the edge of a message plate 18 that is disposed in front of light 14. Formed in the message plate 18 is a series of perforations **18*a* that effectively spell out a distress message that in the particular case illustrated in FIG. 1 includes the word "Help". To camouflage the message plate 18 and to effectively hide the same, a front face plate 22 is secured within the housing 12 forwardly of the message plate 18 and includes a series of perforations 22*a* formed therein. Perforations 22*a* and perforations 18*a* are arranged such that respective perforations align in order that when the light 14 is actuated light shines through the respective perforations 18*a* in plate 18 and through the certain perforations 22*a* that are aligned therewith. It is appreciated that this effectively transfers the distress message formed on plate 18 onto face plate 22**.

To mount the signal device 10 about a particular building or structure, the same is provided with a pair of mounting brackets 24 and 26 that effectively extend from opposite sides of the housing 12, as seen in FIG. 1. The mounting brackets 24 and 26 are preferably extensibly contained within the back side of housing 12 such that the same can be adjustably extended to accommodate a building structure that the same is to be mounted on.

Figure 2:
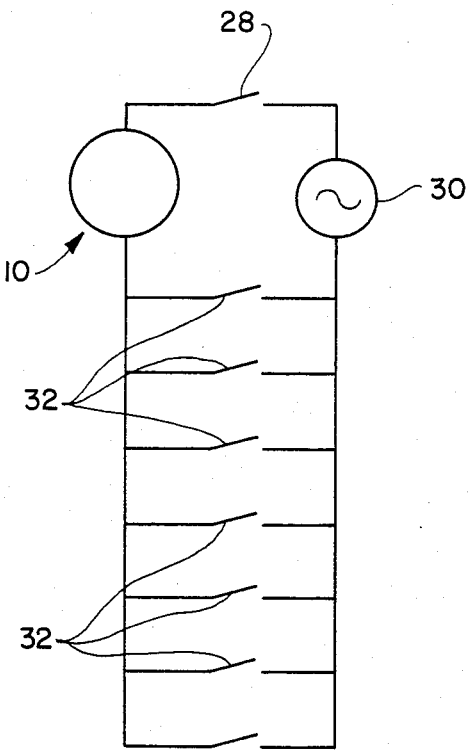
FIG. 2 is an electrical schematic diagram illustrating the electrical circuit for the present invention.

Viewing FIG. 2, an electrical schematic is shown and it is seen that the signaling device 10 is powered by a power source, indicated by the numeral 30 that would preferably be electricity supplied by a 110 volt AC electrical outlet. It is appreciated, however, that other conventional power sources may be utilized. Operatively connected between the signaling device 10 and the power source 30 is a main switch 28 that effectively turns the entire alarm or signaling system on or off.

To actuate the alarm or signaling device 10 when the main switch 28 is on, there is provided a plurality of entry way sensing switching means indicated by the numeral 32 in FIG. 2. This includes a plurality of switches disposed in parallel relationship with respect to each other and situated about the entry ways to the structure, that is about the windows and doors of the structure. The entry way switches are adapted to be actuated and to close a respective electrical circuit around the signaling device 10 and the power source 30 in response to an unauthorized entry into the structure, or more particularly by the movement of a window or door from its normal closed position.

Figure 3:
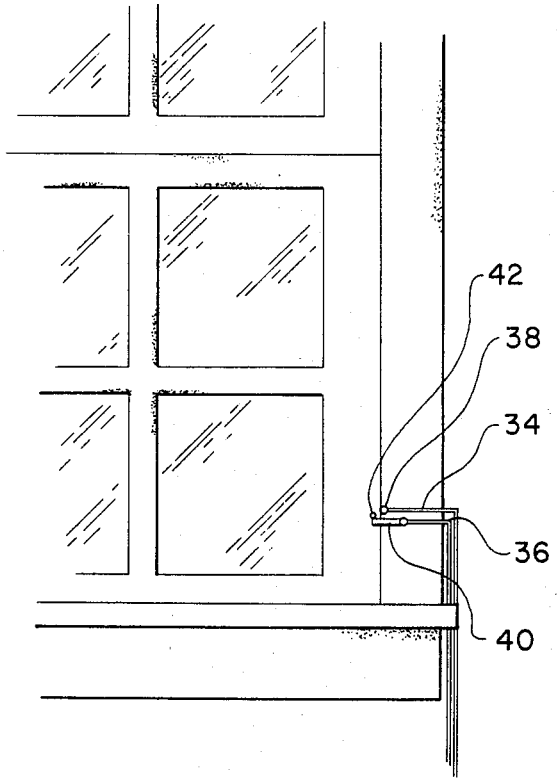
FIG. 3 is a fragmentary front elevational view of a switching mechanism operatively associated with a window of a building structure, the switching mechanism being adapted to actuate the signaling device of the present invention in response to the movement of said window.

Although various types of conventional switches may be utilized, FIG. 3 illustrates the basic principle of a typical switch and in this regard it is seen that extending to a location adjacent the lower window sash is a pair of lines 34 and 36 with one line including a terminal end 38. Secured to the end of the other line is a spring biased switch arm 40 that is biased to rotate clockwise, as viewed in FIG. 3, to where the same would touch and connect terminal end 38 and thereby close the switch so as to effectively close the circuit. To maintain the switch open, a stud or tab 42 is secured to a particular point on the window and is operative to hold the switch arm 40 in an open position. It is appreciated that the alarm or signaling device 10 will be actuated by the opening of the window since switch arm 40 is biased to move clockwise and would contact terminal end 38 and close the circuit in response to the window being raised.

If any of the switches 32 located in the circuit and particularly associated with an entry way to the structure is closed, it is appreciated that a circuit is closed and the alarm or signaling device is actuated when main switch 28 is closed. Once actuated, the light 14 is illuminated and light therefrom is directed through the perforations 18*a* and 22*a* in plates 18 and 22 so as to effectively show or spell out a distress message about face plate 22. Therefore, because the alarm or signal device 10 would be disposed about a conspicuous part of the structure, preferably about the front, passersby and people in the nearby vicinity could see the visual distress message and would be aware that there was an unauthorized entry being made or previously made to the structure or residence. Consequently, it is believed that such an alarm or signaling device of the type disclosed herein would be effective to deter and stop residential burglars and would even be effective in arresting, prosecuting, and convicting those who perpetrate such crimes.

From the foregoing specification, it is seen that the present invention presents a relatively simple and inexpensive alarm or signaling device that is effective to appraise individuals in the vicinity that a particular structure was or is the subject of an unauthorized entry or burglary.

The terms "upper", "lower", "forward", "rearward", etc., have been used herein merely for the convenience of the foregoing specification and in the appended claims to describe the burglar alarm system and its parts as oriented in the drawings. It is to be understood, however, that these terms are in no way limiting to the invention since the burglar alarm system may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A burglar alarm system for indicating that a building is being subject to an unauthorized entry, comprising: a sign type signaling device adapted to be disposed in a conspicuous location about a building and including a housing structure having light means disposed therein, said housing structure including an outer continuously exposed stationary face plate with a plurality of perforations formed therein about a substantial area thereof, and a stationary message plate disposed within said housing between said light means and said face plate with said message plate including a plurality of perforations formed therein in a pattern that effectively spells out a constant stationary distress message, and wherein the perforations in the outer face camouflage the message plate when said light means is not actuated but wherein the perforations in said outer face plate and said message plate are so arranged to always register such that light may project through aligned openings of both said outer face plate and said message plate when said light means is actuated such that the distress message appears across said outer face plate; entry sensing means operatively associated with entry areas of said building such as doors and windows, said entry sensing means including switching means operatively mounted adjacent windows and doors and adapted to be actuated by the opening of such; circuit means operatively interconnecting said sign type signaling device with said entry sensing means such that the actuation of said switching means by the movement of a door or window results in the circuit being closed; and power supply means operatively connected in said circuit for supplying power to said sign type signaling device so as to actuate the same upon the actuation of said entry sensing means.

2. The burglar alarm system of claim 1 wherein said switching means includes a plurality of individual switches disposed in parallel relationship within said circuit means, and wherein each switch is disposed adjacent an entry area and is normally open but is operative to move to a closed position in response to the movement of a window or door from its respective closed position.

3. The burglar alarm system of claim 2 wherein there is provided a master switch operatively connected in said circuit means for switching the entire system between on and off positions.

4. The burglar alarm system of claim 3 wherein said housing structure is of an elongated construction and is generally rectangular in cross section.

5. The burglar alarm system of claim 4 wherein said light means includes an elongated light bulb disposed adjacent said message plate.

6. The burglar alarm system of claim 5 wherein said housing structure includes a pair of mounting plates, each mounting plate projecting outwardly from opposed respective ends of said housing structure.

7. The burglar alarm system of claim 6 wherein each of said mounting plates is extensibly mounted relative to said housing structure in order that the same can be adjustably positioned to properly mount to a building structure.

* * * * *